United States Patent [19]

Peck

[11] 4,180,844

[45] Dec. 25, 1979

[54] POWDER SPRAY APPARATUS AND METHOD FOR COATING INTERIOR SURFACE OF CONTAINERS

[75] Inventor: Richard O. Peck, Lakewood, Colo.

[73] Assignee: Coors Container Company, Golden, Colo.

[21] Appl. No.: 672,591

[22] Filed: Apr. 1, 1976

[51] Int. Cl.[2] ..... B05B 5/00

[52] U.S. Cl. ..... 361/226; 118/622; 427/28; 427/33; 427/236

[58] Field of Search ..... 317/3; 118/622, 630; 117/17, 18, 95, 96, 93.4 R; 361/226, 227, 228; 427/28, 33, 236

[56] References Cited

U.S. PATENT DOCUMENTS 3,904,930 9/1975 Waldron et al. ..... 361/228

*Primary Examiner*—Roy N. Envall, Jr.
*Attorney, Agent, or Firm*—Kyle W. Rost

[57] ABSTRACT

A powder spray machine for internally coating containers such as metal cans comprising infeed means, container positioning means, powder coating apparatus, container outfeed means, and powder control means. A rotary mask plate is provided with openings for reception of the open ends of cans that are carried by a star wheel adjacent the mask plate and are axially aligned with powder spray means adjacent the other side of the mask plate. Means are provided for controlling the overspray of powder to protect areas of the machine and prevent build-up of powder in any area of the machine, and from entering air outside of the machine. A single plate arrangement supports the container positioning means and thus allows access to the container positioning means for powder control means.

26 Claims, 6 Drawing Figures

POWDER SPRAY APPARATUS AND METHOD FOR COATING INTERIOR SURFACE OF CONTAINERS

BACKGROUND OF THE INVENTION

1. Field of the Invention

The invention relates to an apparatus and method for applying powder to a workpiece. More specifically, the invention concerns a method and apparatus for applying an internal powder coating to metal container bodies such as an aluminum can body.

2. Description of the Prior Art

Powder internal coating of can bodies is a relatively new concept combining the technology of the can handling and spray coating arts. Particularly, the handling of aluminum cans presents numerous problems because of the thin can walls that are easily deformed in the process of shaping the can body, printing a label on the exterior, necking the open top end of the can body, and otherwise transporting the aluminum can body on conveyor means between processing stations. The present invention overcomes handling problems in loading the can bodies into the powder coating machine, placing the loaded can bodies into position to be internally coated, moving the can bodies out of coating position, and unloading the can bodies.

Internal coating of cans with powder has presented problems because prior art powder coating guns have often required strong external electric fields to guide the powder to the object to be coated. The "Faraday Cage" effect prevents powder from penetrating recesses of coated objects and accordingly prevents even distribution of powder in the interior of the can body. This problem is partially overcome through the use of electro-gas-dynamic (EGD) powder coating guns such as is disclosed in U.S. Pat. No. 3,853,580 to Gourdine. In addition, research suggests that tribo-electro-gas-dynamic (TEGD) powder coating guns will produce superior results with the present invention. EGD guns typically utilize a dielectric barrel while TEGD guns may have either a dielectric or conductive barrel. Either type of gun may be grounded.

Since the powder guns used with this machine deliver a spray of powder entrained in a propellant gas, means are needed to control the powder that does not remain attached to the object to be coated. In addition, known powder guns operate most effectively when in continuous operation and can spray a substantial amount of powder between workpieces. Means are needed to protect the mechanical parts of the powder coating machine from such overspray.

Prior powder coating technology teaches that an object to be powder coated must be electrically grounded, but some container bodies have nonconductive exterior coatings that make grounding difficult. In addition, equipment for handling aluminum can bodies may require a padded surface, usually constructed of a nonconductive resilient material, to avoid damage to the can bodies. Accordingly, the present invention overcomes the prior art requirement of grounding and allows the use of needed nonconductive resilient surfaces on the can handling equipment and also allows the internal coating of containers after a nonconductive exterior coating has been applied.

SUMMARY OF THE INVENTION

The invention relates to a rotary can handling apparatus for production of internally powder coated can bodies and is designed to operate with a variety of cylindrical metal containers, especially aluminum can bodies. The invention includes container infeed means, container positioning means, powder coating apparatus, container outfeed means, and powder control means.

An object of the invention is to provide a method for powder coating a series of workpieces that is practical on a production line basis. The invention is designed to powder coat can bodies at a rate of 500 cans per minute and above. Speeds of 1000 cans per minute are possible.

A further object is to provide a machine that can powder coat the internal surfaces of a can body, especially an aluminum can body. This invention thus combines the delicate can handling distinctive to the aluminum can handling art together with powder coating apparatus suited to evenly coat the recesses of the aluminum can body, including the typically domed interior bottom found in aluminum beverage cans.

Another important object is to provide powder coating apparatus able to handle aluminum can bodies and powder coat the interior surfaces when the can bodies are not grounded. The apparatus is versatile enough to coat the aluminum can bodies either before or after a nonconductive coating is applied to the can exteriors, and nonconductive materials may be used where desired in the construction of the apparatus without a need to establish a grounding circuit with the cans being coated.

Another object is to provide means for controlling the overspray of powder found in most powder coating operations. The invention is designed to protect areas of the machine subject to mechanical wear from contamination by powder and also to prevent the build-up of powder in any area of the machine. In addition, the invention prevents powder from entering air outside the machine.

An important object is to provide an overspray control system in a powder coating apparatus that prevents powder from coating machine parts when the machine operates during an interruption in the supply of container bodies. The unique support structure of the rotary machine enables the powder guns to operate continuously while an effective overspray control system diverts sprayed powder escaping into the air because of a break in the procession of cans passing through the machine.

DESCRIPTION OF THE PREFERERRED EMBODIMENT

Figure 1:
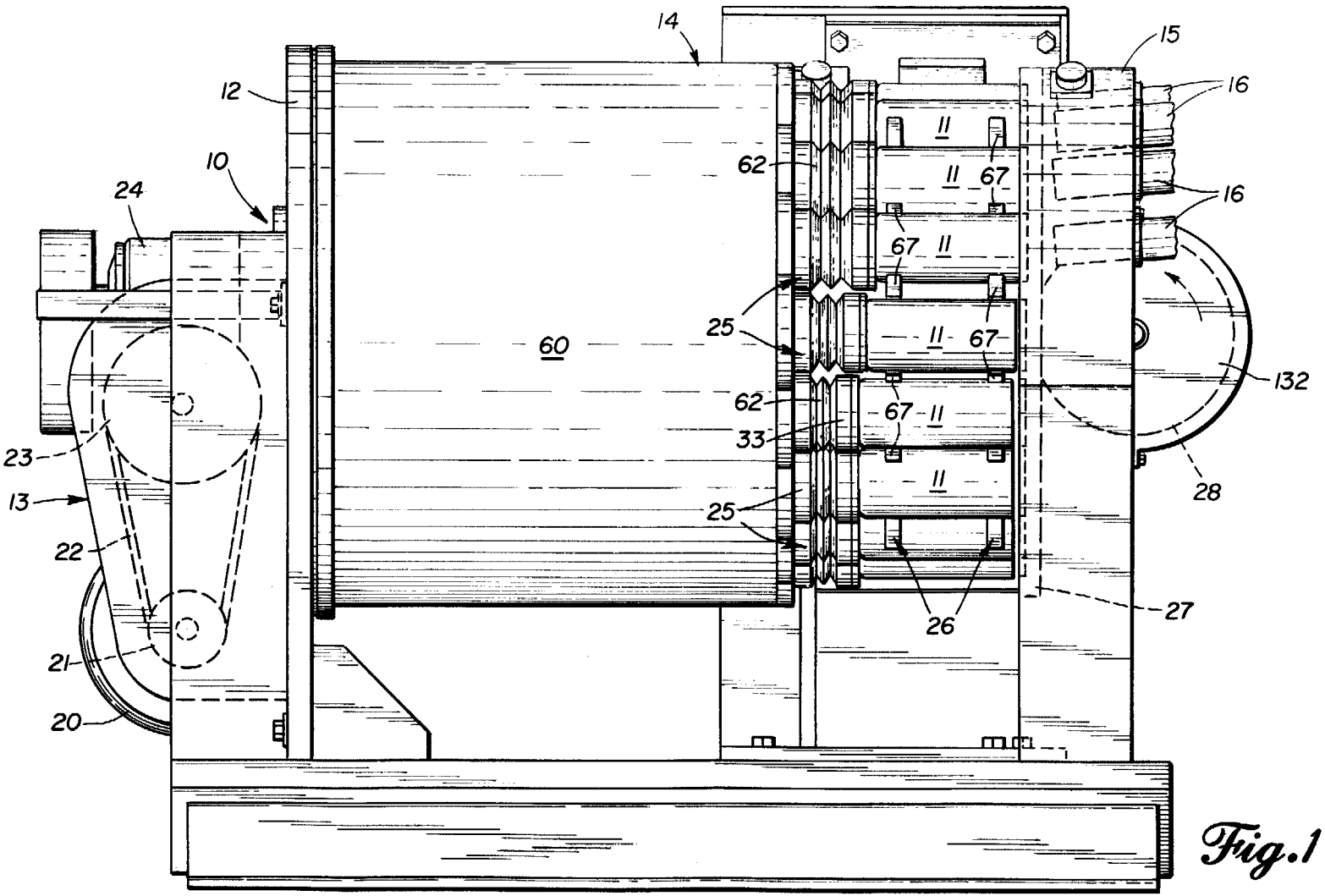
FIG. 1 is a side elevational view of the powder internal coating machine in partial section showing main areas of the machine.

The powder internal coating machine 10 is a rotary container handling apparatus that coats the interior of container bodies such as can bodies 11 with powder that may later be cured to form a protective interior coating in the containers. As shown in FIG. 1, the machine 10 has support means, for example vertical plate 12 having drive means 13 and rotary container positioning mens 14 attached thereto. In addition, the machine has gun support means such as gun support manifold 15 holding a powder coating gun 16 in position to spray powder entrained in gas on the portion of the container to be coated.

The drive means 13 may be located on a first side of plate 12 and includes motor 20 having timing sprocket 21 attached to the motor shaft and connected by belt 22 to timing sprocket 23 that transmits the motor power to gear reducer 24.

Rotary container positioning means 14, which may be on the second side of plate 12, operates from a connection to gear reducer 24. The container positioning means 14 may comprise a plurality of plunger assemblies 25, shown in greater detail in FIG. 2, container support means such as star wheel 26 having a pocket for suporting a container in alignment with each of the plunger assemblies 25, and powder shielding means such as mask plate 27 having a plurality of apertures 36 for receiving the open ends of containers to be powder coated. Each aperture is aligned with a plunger assembly 25 and a pocket of star wheel 26.

Gun support manifold 15 carries at least one powder coating gun 16, which may be grounded, and may carry a plurality of guns 16, each of wich is connected to a supply of powder and propellant gas (not shown). Each gun is aligned to spray powder through the apertures of mask plate 27 as container positioning means 14 rotates, bringing the apertures and container bodies past the stationary gun positions. Gun support manifold 15 may support means for controlling powder overspray, such as brush 28 that cleans powder from mask plate 27.

Figure 2:
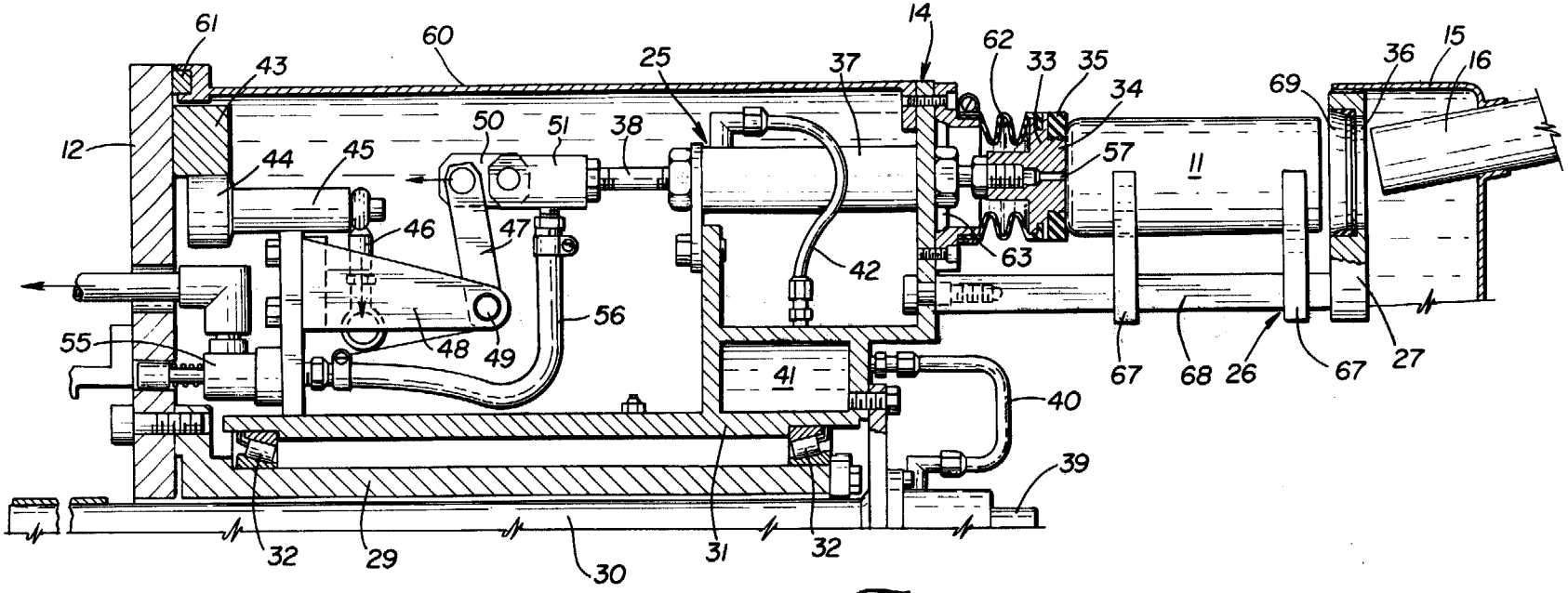
FIG. 2 is an enlarged longitudinal vertical sectional view in the plane of the line 2—2 of FIG. 4 showing details of the container positioning means, and for clarity showing the can body 11 not inserted in mask plate 27.

As shown in FIg. 2, rotary container positioning means 14 may operate from a single rotating shaft, thereby assuring that all parts remain in perfect alignment. Stub shaft 29 may extend from the second side of plate 12, and main drive shaft 30 may extend though the first side of plate 12, where shaft 30 is cooperatively connected to drive means 13, and shaft 30 may extend through stub shaft 29 on the second side of plate 12, where shaft 30 is connected to main hub 31. Main hub 31 rotates on bearings 32 mounted on the outside of stub shaft 29 and carries the container positioning means 14. The use of a single plate 12 and stub shaft 29 to support the container positioning means 14 results in a substantial practical advantage over, for example, the use of two plates to support shaft 30, one at each end thereof. The single plate arrangement allows central access to the container positoning means for the powder control means, as will be later described.

Hub 31 may carry a plurality of plunger assemblies 25, for example sixteen, the assemblies being substantially identical and evenly spaced in radial arrangement about the axis of main shaft 30. Each plunger assembly may comprise a plunger 33 having a substantially flat face 34 and a plunger pad 35 for engaging the closed bottom end of a can body 11 without marring the can. In addition, each assembly may have resilient means urging the plunger 33 to extend, pushing a can 11 into engagement with an aperture 36 of mask plate 27, and also have means for retracting the plunger 33.

The resilient means may be a system of compressed air operating through air cylinder 37, which is connected to shaft 38 upon which plunger 33 is mounted, to urge plunger 33 forward into extended position with a constant resilient force provided by the compressed air. Compressed air supplied through rotating union 39 may travel through air line 40 leading to air chamber 41, which provides a common reservoir of air for all plunger assemblies on the coating machine. From air cylinder 41, air line 42 leads to one side of air cylinder 37, providing a source of compressed air to constantly urge plunger 33 forward.

This constant forward pressure is opposed by retracting means such as a cam operated mechanical system. One such mechanical system comprises stationary cam 43 attached to plate 12, cam follower 44 moving on cam roller pivot 45 to transmit motion imparted by the contour of cam 43 through rod 46 to linkage 47 pivotally mounted on bracket 48 by pin 49. Linkage 47 is pivotally connected to link 50 that in turn is pivotally connected to clevis 51, which is attached to the end of shaft 38. Shaft 38 extends through air cylinder 37 to provide a direct mechanical connection to plunger 33. This mechanical system can overcome the resilient means urging the plunger forward and limits the forward travel of the plunger 33 to the amount allowed by the contour of cam 43.

Each plunger assembly is equipped with means for applying suction to the container engaged by plunger 33, thereby providing an attractive force to hold the container against the plunger as the plunger retracts. When the container is an aluminum can body having the characteristic inwardly dished bottom end, plunger pad 35 assists in sealing the dished bottom end of the can body as suction is applied to the dished area. Suction is applied thorough vacuum manifold 55 on plate 12 and draws through vacuum line 56 attached to shaft 38, which has a holow bore leading to orifice 57 in the face of plunger 33, where the suction is applied.

The plunger assemblies 25 may be sealed to prevent contamination of mechanical parts by powder from the coating process A backing plate, for example a porton of hub 31, may provide a barrier between the plunger 33 and the remainder of the plunger assembly with shaft 38 passing through the backing plate. Housing 60 surrounds the plunger assemblies circumferentially and rotates with them. It is sealed at plate 12 by seal 61 and is attached to rotate with the backing plate portion of hub 31. Each plunger 33 is sealed to the backing plate by bellows 62 fastened to the edge of the plunger. Interconnecting means such as annular passageway 63 allows air to move between the various bellows. When the plungers operate, as a given volume of air is displaced through passageway 63 by the retraction of some plungers compressing their bellows, an equal volume of air is drawn by the extension of other bellows as their plungers extend. Thus, the plunger system is designed to minimize the strain on bellows walls, extending the life of the bellows. Also, if a bellows does break, the internal equality of air volume in the bellows system minimizes the tendency to draw new air, which could be contaminated by powder, into the system.

Air cylinder 37 contains a piston attached to shaft 38, one side of the piston receiving the pressurized air from air chamber 41 and the other side being vented to the atmosphere, but within housing 60. Both to conserve compressed air and to prevent air passage into and out of the area enclosed by housing 60, hub 31 and plate 12, the machine is designed to use a constant volume of air in the resilient means of the plunger assemblies. The plungers 33 extend and retract in coordinated fashion such that when one plunger is fully extended, another is fully retracted, and when one plunger is in an intermediate position of extension, another is in an intermediate position of retraction. As a net result, the air chamber 41 has a balanced inflow and outflow of air from and to the air cylinders 37 at a given moment, and the air moving into and out of the vented end of air cylinders 37 is also constant. Thus, compressed air is used in an extremely efficient manner.

Figure 3:
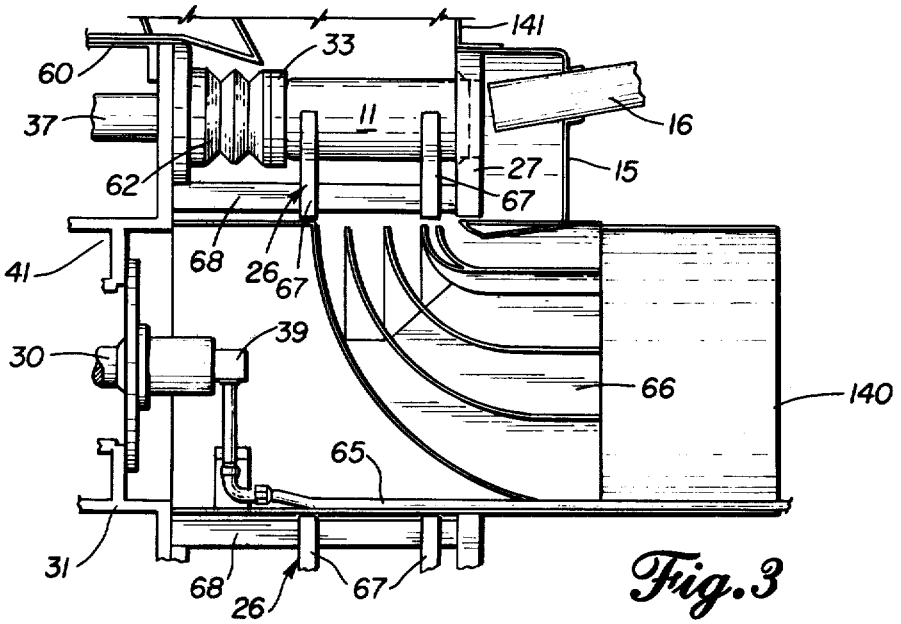
FIG. 3 is an enlarged longitudinal sectional view in the planes of the line 3—3 of FIG. 5 showing details of the air splitter and gun support manifold.

Star wheel 26 is also carried by hub 31 as shown in FIGS. 2 and 3. The star wheel preferably has an annular shape with an open center to accommodate other portions of the powder coating machine, for example compressed air supply conduit 65 leading from a source of compressed air (not shown) to rotating union 39 and also air splitter 66 to be later described. The star wheel has a pocket in alignment with each plunger 33. The star wheel, its plunger, and a container touching either one may be grounded, for example through hub 31 and plate 12. The star wheel 26 may comprise a plurality of plates 67, for example two, and a plurality of support bars 68 holding the two plates 67 in spaced relationship for supporting a container at two points, the contour of the outside edge of plates 67 forming container supporting pockets. This frame-like construction of star wheel 26 is preferred for operating in coordination with the infeed and outfeed means to be described, and also for operating in coordination with the powder control means. The open construction of the star wheel allows mechanical parts of the infeed and outfeed means to operate in the area between the outer sweep of the support bars 68 and the inner edge of the container pockets and allows air passing through air splitter 66 to pass through the star wheel.

Hub 31 may also carry mask plate 27, for example by having mask plate 27 mounted on support bars 68 as shown in FIG. 2 and 3. The mask plate is preferably constructed of a nonconductive material such as fiberglass in order to minimize interference with charged powder expelled by powder guns 16 and to prevent powder from adhering to the mask plate. Each aperture 36 is aligned with a corresponding plunger 33 and pocket of star wheel 26 to receive a container end when the plunger pushes the container toward the mask plate. Because repeated insertion of container ends into apertures 36 may cause wear, each aperture 36 may be provided with an insert 69 constructed of durable material, for example ceramic material, to resist wear and simplify repair of a worn aperture. Each aperture has a beveled edge for guiding the end of a container being inserted and has a flanged end to hold the inserted end of the container. Mask plate 27, like star wheel 26, may be constructed in an annular shape with an open center to accommodate nonrotating portions of the powder coating machine. Mask plate 27 serves both as a positioning means holding containers to be coated in a uniform portion with respect to powder coating gun 16 and as a shielding means preventing powder from being sprayed on the can exteriors or on the star wheel and plunger.

No grounding means are required in the container positioning means 14 for grounding the can bodies 11. For example, the star wheel 26 may be constructed of nonconductive material and the can bodies may have nonconductive coating on their exteriors before being fed into the star wheel. Also, plunger pad 35 is constructed of a resilient material that may be nonconductive and is the only part of plunger assembly 25 that contacts a can body, thus providing careful handling for easily deformed can bodies, for example aluminum can bodies. An important feature of the powder coating machine is the ability to adequately coat the interior of ungrounded containers, thus allowing the use of nonconductive machine parts where desired from a can handling viewpoint and also allowing can bodies to be externally coated with nonconductive coatings, if desired, before powder coating the interiors.

Figure 4:
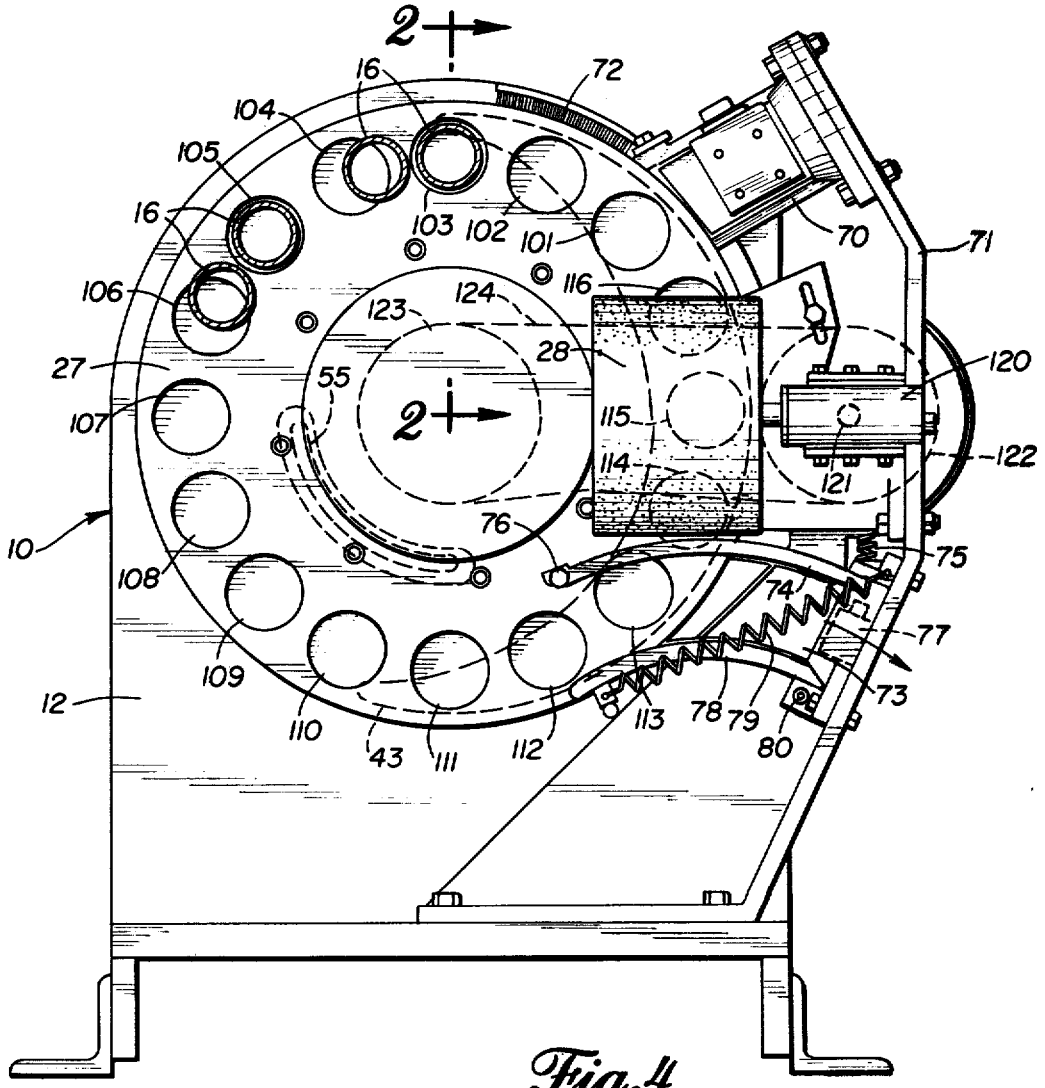
FIG. 4 is a front elevational view in partial section of the machine without the gun support manifold, but showing portions of the container positioning means, container infeed and outfeed means, and mask plate brush.

In FIG. 4, the container infeed means may comprise infeed track 70 mounted on can track bracket assembly 71. Track 70 may include a pair of parallel rails and the rails may extend into the annular area of rotation of star wheel 26, for example between plates 67, to smoothly guide container bodies into the pockets of the star wheel. A supply of container bodies is fed, for example under force of gravity, into track 70 where the individual container bodies enter a pocket of star wheel 26 as the star wheel rotates past infeed track 70. Infeed brush 72 serves as guide means securing each container fully in its pocket in the star wheel, thereby avoiding damage to mask plate 27 from an improperly seated container being pushed against the surface of the mask plate. While brush 72 is preferred, other resilient means or a guide rail could serve the same purpose but could require precise adjustment not needed with a resilient brush.

The container outfeed means may comprise outfeed track 73 also mounted on bracket 71. As the container bodies are carried in the rotating container positioning means 14 past outfeed track 73, track 73 diverts the containers out of their pockets in the star wheel 26 and guides them as they roll out of the machine, for example by force of gravity. A portion of track 73, for example top wall 74, may extend into the annular area of rotation of the star wheel, for example into the area between plates 67, to guide the container bodies out of their pockets in the star wheel and into the outfeed track 73. Track 73 is designed to prevent damage to an excessive number of containers if a container should become jammed in the outfeed track. A pivotable section of track 73, such as top 74, is held in place by resilient means such as spring 75 and by pivot means such as pivot bolt 76. The pressure of a series of cans pushing against a jammed can in track 73 will cause wall 74 to pivot upwardly on bolt 76, overcoming the pressure of spring 75 and releasing safety switch 77, stopping the rotation of the container carrying means.

Bottom 78 of track 73 provides easy access for removing jammed can bodies from the outfeed track. Bottom 78 is held in place by spring 79 and may be pivoted downwardly at pivot point 80, opening the track for removal of jammed cans.

Figure 5:
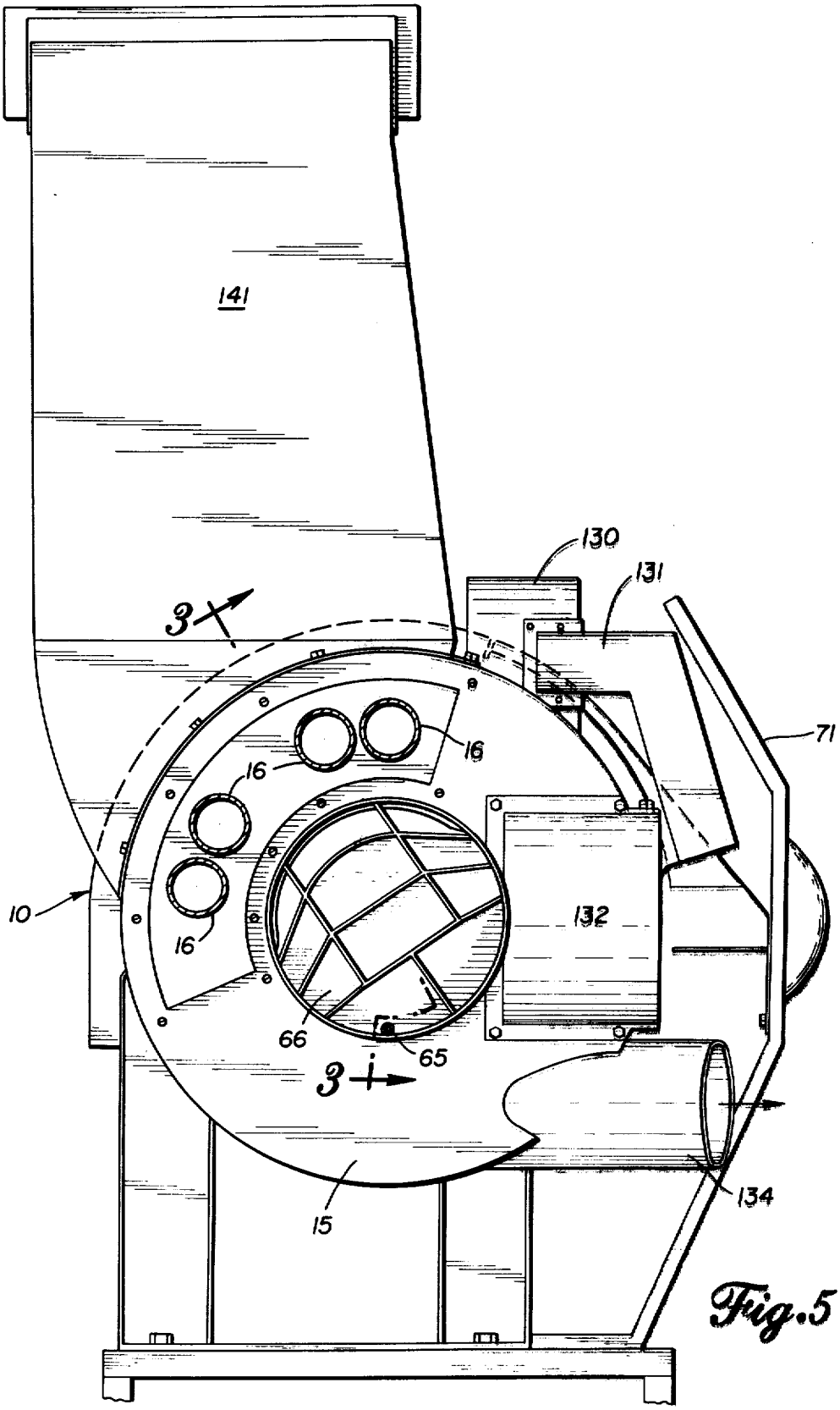
FIG. 5 is a front elevational view showing the gun support manifold and powder control means.

The powder coating apparatus includes gun support means and a powder coating gun. As shown in FIGS. 3 and 5, gun support manifold 15 has an annular shape with an open center to accommodate nonrotating equipment such as air splitter 66. The manifold is nonrotating and supports at least one powder coating gun 16 in position to spray powder through an aperture 36 of mask plate 27. It is anticipated that four guns 16 may be mounted on manifold 15, two as primary guns and two as reserve guns. It is desirable that the first coating of powder settle on the coated object before the second coating is applied; hence, the guns are grouped with the first primary and reserve gun at a first end of the coating area and the second primary and reserve gun at a second end of the coating area, leaving a central area where first applied powder can settle in the container.

In operation, drive means 13 rotates the container positioning means 14 on main shaft 30 and hub 31. A supply of can bodies 11 from an outside source (not shown) enters infeed track 70 where the cans fall into the passing pockets of rotating star wheel 26. Referring now to FIG. 4, the mask plate 27 rotates together with the remainder of the container positioning means 14 in a counterclockwise direction. The aperture positions shown in FIG. 4 will be referred to in numerical order from 101 to 116 to describe the operation of the machine during a single rotation in the process of coating a single can body. A can body 11 enters star wheel 26 at position 101 at which point cam 43 is holding the associated plunger in retracted position. As the can is rotated to position 103, the contour of cam 43 allows the plunger to extend, inserting the end of the can body into its associated aperture in mask plate 27. As soon as the can is inserted in the aperture, the can may be treated by a powder coating gun 16. While treatment by a single gun 16 may be adequate to powder coat the can, it is anticipated that a series of treatments may be needed to apply an adequate coating. Hence, primary guns 16 may be located approximately at positions 103 and 105, reserve guns 16 located approximately at positions 104 and 106 for immediate activation if any of the primary guns should fail. At position 107 the coating process is complete and vacuum manifold 55 is contacted by the plunger assembly 25 in preparation for withdrawing the can end from the aperture of mask plate 27. Cam 43 is again encountered while the plunger assembly is in contact with vacuum manifold 55, for example at position 110, activating the plunger assembly in conjunction with the applied suction at orifice 57 to pull the can body free of mask plate 27 as the plunger retracts. When the vacuum manifold 55 ends, for example at position 112, the can body has been fully retracted from the aperture of the mask plate and may drop out of the pocket and into outfeed track 73, prompted by the continued rotation of the star wheel.

Efficient operation of powder coating guns presently requires that the guns operate in substantially continuous manner while a series of containers is passed before the guns with mask plate 27 protecting the machine from being coated with powder from the spray between containers. Powder control means are needed to keep mask plate 27 free of powder on long term operation of the machine and also to remove powder from the star wheel and plunger areas in the event that a pocket of the star wheel fails to pick up a can body, allowing the powder gun to spray through an aperture of the mask plate that does not contain an inserted can body.

One powder control means may be mask plate brush 28, which may be powdered to rotate against the direction of mask plate rotation, for example by a power train comprising spiral bevel gear drive 120 (FIG. 4) attached to bracket 71 and turning brush 28, brush drive shaft 121 powering gear drive 120, timing gear 122 keyed to shaft 121, timing gear 123 keyed to main shaft 30, and belt 124 transmitting the rotation of gear 123 to gear 122. A belt tensioner (not shown) may be used on belt 124. Brush 28 continuously cleans powder from the side of the mask plate facing the powder gun while the mask plate is rotating, for example at position 115.

Another powder control means may be a first forced air exhaust system shown in FIG. 5 that carries powder away from the gun support manifold 15. Air intake duct 130 carries clean dry air from an external source (not shown) into gun support manifold 15 where the air sweeps around the manifold, for example in a counterclockwise direction in FIG. 5 because of the interference of brush 28, and carries away powder that may have bounced off of mask plate 27 or out of the can body 11. Brush duct 131 channels part of the clean dry air to the side of the mask plate opposite from the brush, where the air picks up the powder that the brush 28 removes from the mask plate, andd this air joins the air from the gun support manifold 15 as both exit at exhaust duct 134. The air then may be routed to a cyclone or other collection means (not shown) where the powder is separated from the air and may be reclaimed. Brush duct 131 also encloses the brushing operation to prevent powder from escaping from the gun support manifold 15. Brush cover 132 provides access to the brush 28.

Figure 6:
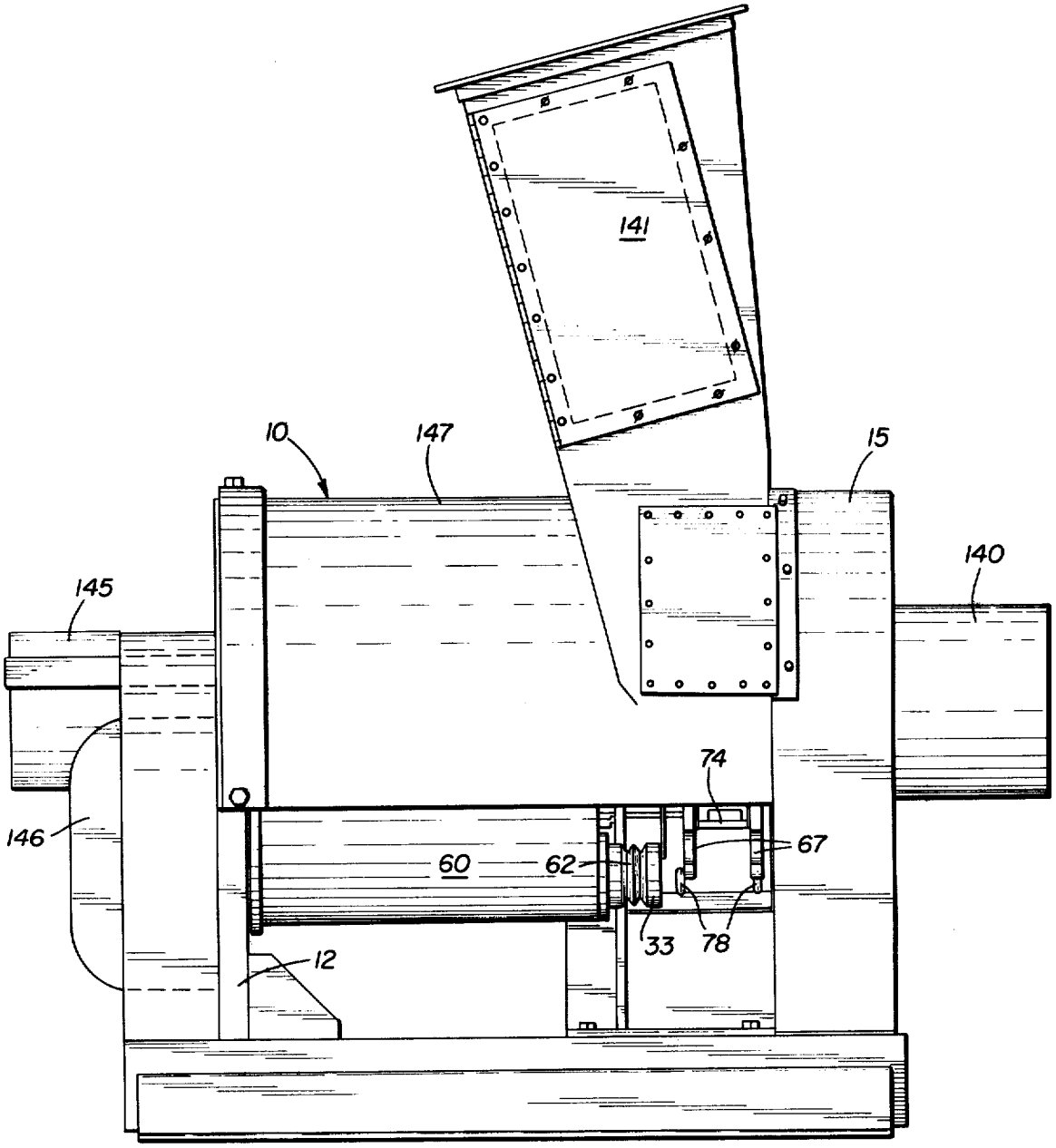
FIG. 6 is a side elevational view in partial section showing the machine guards and ducts.

A second closed forced air exhaust system shown in FIGS. 3, 5, and 6 may be used to remove powder from the star wheel and plunger areas. Intake duct 140 directs air into air splitter 66, which changes the direction of the air with a minimal energy loss. The air then sweeps through openly constructed star wheel 26, picking up any powder entering the area where containers are being powder coated and exits through exhaust hood 141. The containers are not swept away by the air because they are inserted in the apertures of mask plate 27 and held by plungers 33 while rotating through the air stream, but the powder intended for a missing container is swept out of the machine without having substantial contact with the plungers or star wheel. Exhaust hood 141 carries the exhaust air to an external filter and blower (not shown) where the powder is removed and the air recirculated through duct 140. The clean dry air of the first forced air system after passing through the gun support manifold may be routed into the second forced air system, thereby making the air in the second system clean and dry over a period of continued operation. A corresponding amount of air is vented from the second closed system.

The complete powder internal coating machine 10 may include a number of guards covering moving parts, as shown in FIG. 6. The guards may include brush drive guard 145, main drive guard 146, and machine guard 147, which may be part of exhaust hood 141.

I claim:

1. An improved powder coating machine for applying a powder coating to the interior of ungrounded metallic container bodies having an open end, wherein the machine is of the kind having container positioning means conveying an array of said containers through an area for spray coating, said container positioning means including a shielding mask plate having a plurality of apertures aligned with openings in the container bodies; a series of plungers disposed opposite each of said apertures for resiliently pressing the container bodies against said mask plate; and a powder spray gun positioned adjacent to the mask plate for spraying charged powder through said apertures to coat the inside surface of the container bodies; the improvement comprising:

(a) non-conductive pad means on said plungers for directly contacting said container bodies and preventing grounding of the container bodies to the plungers;

(b) said mask plate being constructed of non-conductive material for minimizing interference with charged powder from said powder spray gun and maintaining the container bodies in an ungrounded condition; and (c) said powder spray gun being a tribo-electric-gas-dynamic powder coating gun.

2. An improved powder coating machine for applying a powder coating to the interior of metallic container bodies having an open end, wherein the machine is of the kind having infeed means conveying said container bodies from an exterior source into the powder coating machine; rotary container positioning means receiving and supporting the container bodies in spaced positions and holding the container bodies in position to be powder coated on a first side of an associated mask plate having apertures through which the container interiors are exposed to the second side of the mask plate; powder coating apparatus on the second side of the mask plate spraying charged powder on the container body interiors; and outfeed means conveying said container bodies out of the machine to an exterior point, wherein the improvement comprises first powder control means for substantially preventing powder sprayed through a mask plate aperture at one of said spaced positions failing to hold a container body from coating said rotary container positioning means.

3. The powder coating machine of claim 2, further comprising second powder control means including a brush removing powder from portions of said container positioning means.

4. The powder coating machine of claim 2, wherein said infeed means comprises a can infeed track guiding container bodies into said container positioning means under force of gravity, and an infeed brush attached to the infeed track for seating container bodies in said container positioning means.

5. The powder coating machine of claim 1, wherein said container positioning means comprises:

(a) a single vertical support plate carrying plunger activating means, (b) a hub rotatably attached to said plate on a horizontal axis of rotation, (c) a plunger assembly mounted on said hub and having an associated plunger positioning a container body in response to said plunger activating means as said hub rotates, (d) container support means mounted on said hub and supporting a container body received from said infeed means, (e) drive means rotating said hub on its axis of rotation, and (f) wherein said mask plate is connected to said hub for rotation therewith and an aperture in the mask plate is axially aligned with said plunger for receiving the open end of a container body.

6. The powder coating machine of claim 5, further comprising a stub shaft mounted on said vertical plate, and a main drive shaft passing through the plate and stub shaft and connected to said drive means at one end and attached to said hub at a second end, said main drive shaft transmitting the power of the drive means to rotate the hub.

7. The powder internal coating machine of claim 5, wherein said plunger assembly includes mechanical means for moving said plunger in a first direction, comprising a shaft attached to the plunger and connected to a pivotally mounted linkage that pivots in response to said plunger activating means to move the plunger in said first direction; and the plunger assembly further includes resilient means for urging said plunger in a second direction, comprising an air cylinder attached to the plunger and an associated air line bringing a supply of compressed air to one side of the air cylinder, causing the cylinder to urge the piston in said second direction.

8. The powder coating machine of claim 7, further comprising a plurality of plunger assemblies and associated plungers, and an air chamber attached to said container positioning means providing a common reservoir of compressed air to each air cylinder through its associated air line.

9. The powder coating machine of claim 8, further comprising a rotating union attached to said hub, a compressed air supply conduit bringing compressed air from an external source to said rotating union, and an air line connecting the rotating union to said air chamber and delivering air maintaining pressure in said chamber.

10. The powder coating machine of claim 7, wherein said plunger assembly further comprises a plunger face having an orifice therein, and means for applying suction through said orifice in the plunger face for attaching the plunger to a container body while the plunger retracts, pulling the container body.

11. The powder coating machine of claim 5, further comprising a plurality of plunger assemblies and associated plungers, a backing plate behind said plungers and rotating with said hub, a bellow associated with each plunger and sealing the space between the plunger and the backing plate, and interconnecting means providing a passageway between the interior volumes of said bellows.

12. The powder coating machine of claim 5, wherein said container support means includes a frame-like star wheel comprising a plurality of support bars spaced to allow ventilation between them and connected to said hub for rotation therewith, and a plurality of annular plates spaced to allow ventilation between them and connected to said support bars, said plates having an outer edge contoured to cooperatively form a plurality of container supporting pockets.

13. The powder coating machine of claim 5, wherein said mask plate further comprises an insert of wear resistant material in said aperture protecting the mask plate against wear from container ends inserted in the aperture.

14. The powder coating machine of claim 13, wherein said insert is constructed of ceramic material.

15. The powder coating machine of claim 2, wherein said powder coating apparatus comprises a gun support manifold adjacent to said container positioning means, and a powder coating gun mounted in said gun support manifold spraying charged powder into said container bodies.

16. The powder coating machine of claim 15, wherein said powder coating apparatus further comprises four powder coating guns spaced into pairs, a first pair comprising a primary gun and a reserve gun and a second pair comprising a primary gun and reserve gun.

17. The powder coating machine of claim 2, wherein said outfeed means includes a can outfeed track having means preventing damage to an excessive number of jammed container bodies, comprising (a) a section of said outfeed track held by resilient means in a first position and pivotable to a second position by the pressure of jammed container bodies in the outfeed track, (b) a safety switch engaged by said section when in said first position but released when in said second position and stopping the outfeed of container bodies, and (c) a door on said outfeed track providing access for the removal of jammed container bodies.

18. An improved powder coating machine for use with a supply of open ended metal container bodies, a supply of compressed air, and a source of vacuum, wherein the machine is of the kind having a rotating hub driven by drive means; a plurality of plunger assemblies spaced around and rotating with said hub, each of said plunger assemblies having an extendable and retractable plunger; a star wheel having a plurality of container supporting pockets, each in alignment with one of said plungers, and attached to rotate with said plunger assemblies; a mask plate having a first side facing said star wheel and having a plurality of apertures, each aligned with one of said container supporting pockets, and attached to rotate with the star wheel; container infeed means guiding and seating said container bodies into said star wheel pockets from an external source; gun support means adjacent to a second side of said mask plate and holding a powder coating gun spraying charged powder through the apertures of the mask plate into said open ended container bodies; and container outfeed means guiding the sprayed container bodies out of the star wheel, wherein the improved machine further comprises:

(a) support frame means connected to only one side of said hub for allowing central access to the other side of said hub; and (b) said star wheel having an open-framed structure with a plurality of radial openings with respect to the rotating hub for allowing passage of air therethrough.

19. The powder coating machine of claim 18, having a first powder control means comprising a closed air exhaust system blowing through said open-framed star wheel to divert powder from said plungers and star wheel.

20. The powder coating machine of claim 19, wherein said gun support means is an annular manifold having an open center, said star wheel and mask plate are annularly shaped and have an open center, and said closed air exhaust system further comprises (a) an air splitter in said open center of the gun support manifold, star wheel, and mask plate guiding air passing through said open-framed star wheel, and (b) a duct and hood assembly forming a closed system bringing air to said air splitter and star wheel and removing the air in a continuous path leading through an external filter and blower.

21. The powder coating machine of claim 19, having a second powder control means comprising (a) an intake duct bringing clean dry air into said gun support means from an external source to carry off excess powder, (b) an exhaust duct removing said clean dry air and carried powder from the gun support means, (c) a brush urged against said second side of the mask plate to remove powder, and (d) a brush duct bringing clean dry air from said intake duct past the brush for removing brushed powder.

22. The powder coating machine of claim 21, further comprising means for carrying a volume of clean dry air from the exhaust duct of said second powder control means into said closed air exhaust system, and means for venting an equal volume of air from the closed air exhaust system.

23. A method of automatically applying a powder coating to the interior surface of ungrounded metallic container bodies having an open end, comprising:

(a) placing the container bodies on a support means moving through a powder coating area;

(b) engaging the container bodies with non-conductive retaining means;

(c) spraying charged powder into said open end of the container bodies from a tribo-electric-gas-dynamic powder coating gun during movement of said support means while maintaining the container bodies in ungrounded condition with respect to the support means and retaining means;

(d) disengaging the container bodies from the retaining means; and (e) removing the coated container bodies from the support means.

24. The method of claim 23, further comprising forcing air through the support means in the powder coating area to remove powder sprayed where no can body has been placed on the support means.

25. The method automatically applying a powder coating to the interior surface of a cylindrical metallic container body having at least one open end and having a nonconductive coating on the outer cylindrical wall thereof, comprising:

(a) conveying said container on a star wheel contacting the nonconductive outer coating of the container:

(b) applying a nonconductive portion of a plunger against the container body to move the container body with respect to the star wheel and into engagement with a nonconductive mask plate having an aperture aligned with the open end of the container:

(c) moving said star wheel and mask plate past at least one powder spray gun expelling charged powder in the direction of said open container end and mask plate aperture to spray said powder into the container body;

(d) applying suction through said plunger to hold the container body in contact therewith and drawing the plunger and container body away from the mask plate to disengage the container body from the mask plate;

(e) releasing suction through the plunger; and (f) removing the container body from the star wheel.

26. The method of claim 25, wherein said star wheel is annular and has frame-like construction, further comprising:

forcing air radially outwardly through the frame-like construction of said star wheel when the star wheel is moving the container body past said powder spray gun.

* * * * *